United States Patent [19]

Leonard et al.

[11] 4,309,876

[45] Jan. 12, 1982

[54] METHOD AND APPARATUS FOR SATISFYING HEATING AND COOLING DEMANDS AND CONTROL THEREFOR

[75] Inventors: Gary S. Leonard, Minoa; Thomas M. Zinsmeyer, Pennellville, both of N.Y.

[73] Assignee: Carrier Corporation, Syracuse, N.Y.

[21] Appl. No.: 87,290

[22] Filed: Oct. 22, 1979

[51] Int. Cl.[3] ..... F25B 7/00; F25B 5/00

[52] U.S. Cl. ..... 62/79; 62/117; 62/175

[58] Field of Search ..... 62/238 E, 324 D, 175, 62/79, 117, 196 B; 237/2 B

[56] References Cited

U.S. PATENT DOCUMENTS 3,278,111 10/1966 Parker ..... 417/32

*Primary Examiner*—William E. Wayner

*Attorney, Agent, or Firm*—J. Raymond Curtin; John S. Sensny

[57] ABSTRACT

Apparatus for satisfying heating and cooling demands including a cooling circuit having a high pressure side and a low pressure side, and a heating circuit including a booster compressor for drawing and compressing refrigerant from the high pressure side of the cooling circuit. Also disclosed is a sensor for sensing the temperature of vapor discharged from the booster compressor, and a control responsive to the sensor for terminating the heating action of the heating circuit when the temperature of vapor discharged from the booster compressor exceeds a preset value.

20 Claims, 2 Drawing Figures

METHOD AND APPARATUS FOR SATISFYING HEATING AND COOLING DEMANDS AND CONTROL THEREFOR

BACKGROUND OF THE INVENTION

This invention relates generally to refrigeration, and more specifically to refrigeration methods and apparatus for simultaneously satisfying heating and cooling demands.

Refrigeration apparatus or machines are frequently employed to cool a fluid such as water which is circulated through various rooms or enclosures of a building to cool these areas. Often, the refrigerant of such machines rejects a relatively large amount of heat at the condenser of the machine. This rejected heat is commonly dissipated to the atmosphere, either directly or via a cooling fluid that circulates between the condenser and a cooling tower. Over a period of time, the rejected heat represents a substantial loss of energy, and much attention has been recently directed to reclaiming or recovering this heat to satisfy a heating load or demand.

One general approach to reclaiming this heat is to employ a booster compressor to draw and further compress a portion of the refrigerant vapor passing through the condenser of the refrigeration machine. This further compressed vapor is then passed through a separate, heat reclaiming condenser. A heat transfer fluid is circulated through the heat reclaiming condenser in heat transfer relation with the refrigerant passing therethrough. Heat is transferred from the refrigerant to the heat transfer fluid, heating the fluid and condensing the refrigerant. The heated heat transfer fluid may then be used to satisfy a present heating load or the fluid may be stored for later use, and the condensed refrigerant is returned to the refrigeration circuit for further use therein.

With refrigeration machines having both a refrigeration, or cooling, circuit and a heating circuit has described above, it is desirable to vary the capacities of the heating and cooling circuits to meet changing heating and cooling loads, and typically this is done by varying the refrigerant flow rates through the circuits. Difficulties may arise, though, when the refrigerant flow rate through the heating circuit is very low. More particularly, under such conditions, the booster compressor may significantly raise the temperature of the refrigerant vapor passing therethrough, and the refrigerant may approach temperature levels which cause the refrigerant to chemically breakdown. Such a chemical breakdown of the refrigerant may produce acidic compounds which can damage the structure of the refrigeration machine. Preventing excessive vapor temperature in the heating circuit is complicated by a number of facts. First, it is preferred to vary the capacities of the heating and cooling circuits substantially independent of each other. Thus, the capacity of the cooling circuit may be anywhere between its minimum and maximum values when excessive vapor temperatures are approached in the heating circuit. Second, with certain refrigeration machines of the general type described above, the specific manner for preventing excessive vapor temperatures in the heating circuit will vary in accordance with the actual capacity of the cooling circuit when these excessive temperatures are approached.

SUMMARY OF THE INVENTION

In light of the above, an object of the present invention is to improve methods and apparatus for satisfying heating and cooling demands.

Another object of this invention is to terminate the heating action of a booster type, heat reclaiming refrigeration machine when the temperature of vapor in the heating circuit of the machine becomes undesirably high.

A further object of the present invention is to take a booster type, heat reclaiming refrigeration machine out of a heating and cooling mode of operation and either put the machine into a cooling only mode of operation or shut the machine down when excessive vapor temperatures are reached in the heating circuit of the machine.

These and other objectives are attained with apparatus for satisfying heating and cooling demands comprising a cooling circuit having a high pressure side and a low pressure side, and a heating circuit including a booster compressor for drawing and compressing refrigerant vapor from the high pressure side of the refrigeration circuit. The apparatus also comprises a sensor for sensing the temperature of the vapor discharged from the booster compressor, and a control responsive to the sensor for terminating the heating action of the heating circuit when the temperature of the vapor discharged from the booster compressor exceeds a preset temperature.

A BRIEF DESCRIPTION OF THE DRAWINGS

FIG. 1 is a schematic representation of a vapor compression refrigeration machine incorporating teachings of the present invention; and FIG. 2 is a schematic drawing of an electrical control circuit for the refrigeration machine shown in FIG. 1.

DETAILED DESCRIPTION OF THE PREFERRED EMBODIMENT

Figure 1:
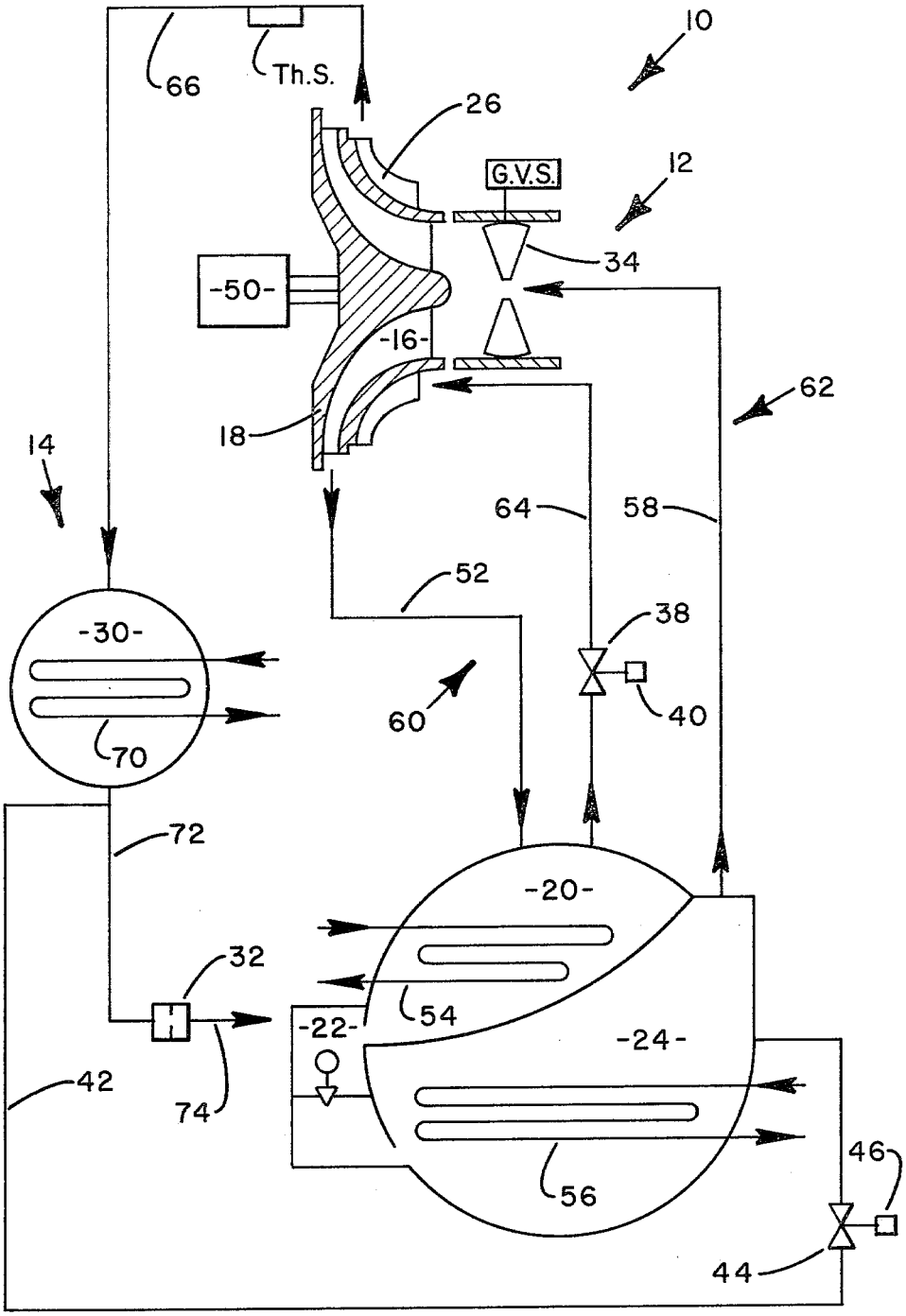

Referring to FIG. 1, there is depicted refrigeration machine 10 employing teachings of the present invention. Machine 10 includes, generally, cooling circuit 12 and heating circuit 14. Cooling circuit 12, in turn, includes primary compressor such as first stage 16 of two stage compressor 18, primary condenser 20, primary expansion means 22, and evaporator 24. Heating circuit 14 includes booster compressor means such as second stage 26 of compressor 18, heat reclaiming condenser 30, and auxiliary expansion means such as orifice 32. Inlet guide vanes 34 are provided to control the refrigerant flow through first stage 16 of compressor 18 and, thus, through cooling circuit 12. Positioning means (not shown) are provided to move guide vanes 34 between minimum and maximum flow positions. Valve 38 is utilized to regulate the refrigerant flow through second stage 26 of compressor 18 and, hence, through heating circuit 14. Positioning means such as reversible electricl motor 40 is provided for moving valve 38 between minimum and maximum flow positions. Vent line 42 connects heating circuit 14 with a low pressure region such as evaporator 24, vent line valve 44 regulates refrigerant flow through the vent line, and positioning means such as electrically actuated solenoid 46 moves the vent line valve between open and closed positions. Drive means such as electric motor 50 is employed to simultaneously drive first and second stages 16 and 26 of compressor 18.

Figure 2:
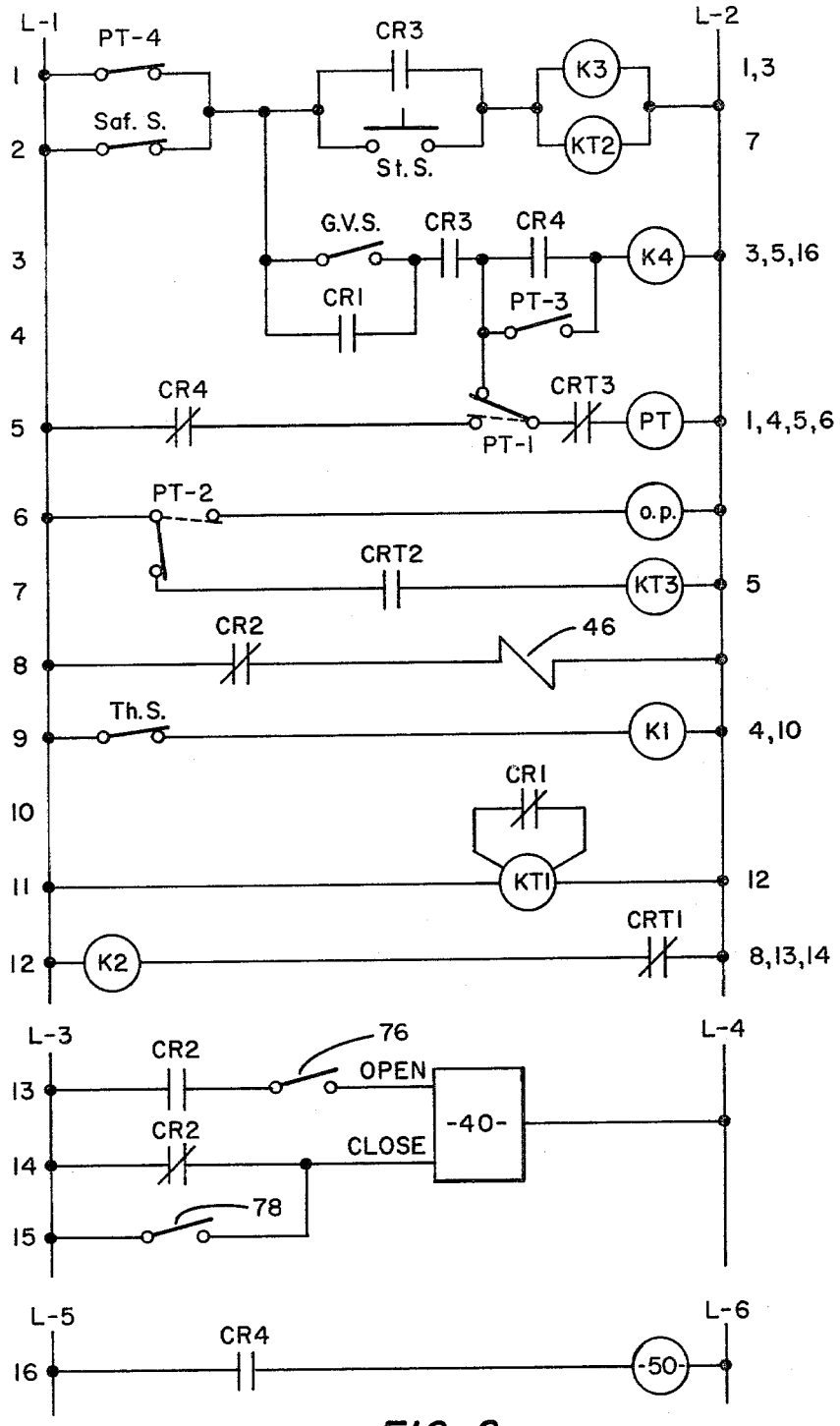

An electrical control circuit for motors 40 and 50 and solenoid 46 is shown in FIG. 2. To simplify references to FIG. 2, the Figure includes numerical references 1–16 at the left thereof to indicate various lines in the Figure. Solenoid 46 is shown in line 8 of FIG. 2 while motors 40 and 50 are shown, respectively, in lines 13 and 16 of the Figure. Solenoid 46 is connected to a first source of electrical energy represented by lines L-1 and L-2 in FIG. 2. Further, FIG. 2 shows motors 40 and 50 connected, respectively, to second and third electrical energy sources, with lines L-3 and L-4 representing the second source and lines L-5 and L-6 representing the third source of electrical energy. As will be apparent to those skilled in the art, numerous types of electrical energy sources may be used with the circuit shown in FIG. 2. One suitable set of sources, for example, provides approximately a 115 volt alternating current between lines L-1 and L-2, about a 28 volt alternating current between lines L-3 and L-4, and approximately a 460 volt alternating current between lines L-5 and L-6, with each of the above currents having a frequency of about 60 hertz.

The circuit shown in FIG. 2 includes numerous relay coils and relay contacts controlled thereby, and attention is directed to the right hand side of FIG. 2 where adjacent to each line having a relay coil there are identified the lines containing relay contacts controlled by that coil. Also, the symbol "K" designates the relay coil while the symbol "CR" designates the contacts controlled thereby. For example, coil K3 in line 1 controls contacts CR3 in lines 1 and 3, and timer relay coil KT1 in line 11 controls contacts CRT1 in line 12. As is customary in the art, the relay contacts shown in FIG. 2 are illustrated in their inactive or de-energized position. Further, it should be understood that the controls for refrigeration machine 10 include a variety of switches and other devices not shown in FIG. 2. For example, the controls include a water pump switch and a plurality of indicator lights. The addition of these devices is well within the purview of those skilled in the art, and they have been omitted from FIG. 2 for the sake of clarity.

Program Timer PT is schematically shown in line 5 of FIG. 2. Program Timers are well known in the art and are used to produce a sequence of events. Program Timer PT of machine 10 controls switches PT-1, PT-2, PT-3, and PT-4 located, respectively, in lines 5, 6, 4, and 1 of FIG. 2, and the Program Timer runs these switches through an ordered series of steps. If the Program Timer is de-energized at some point in its sequence, when reenergized the timer will restart at the point in its sequence where it was de-energized. Furthermore, as is well known in the art, the Program Timer will run for a period of time between each step in its sequence, and each time period may be individually adjusted.

Under initial conditions, switches PT-1 and PT-2 are in the positions shown in full lines in FIG. 2, switch PT-3 is open, and switch PT-4 is closed. At the same time, thermostatic switch Th.S. in line 9 of FIG. 2 is closed and, hence, relay coil K1 in line 9 is energized. Because coil K1 is energized, contacts CR1 in line 4 are closed and contacts CR1 in line 10 are open. With contacts CR1 open in line 10, timer relay KT1 (discussed in greater detail below) in line 11 is deenergized; and with relay KT1 de-energized, contacts CRT1 in line 12 are closed. Because contacts CRT1 are closed, relay coil K2 in line 12 is energized. As a result of this, contacts CR2 in line 13 are closed, and contacts CR2 in lines 8 and 14 are open.

To initiate operation of machine 10, start switch St.S. in line 2 of FIG. 2 is manually closed. Referring to FIG. 2, current passes through closed switch PT-4 in line 1 and through start switch St.S., energizing relay coils K3 and KT2 in lines 1 and 2 respectively. Coil KT2 is a delay timer which closes contacts CRT2 in line 7 after a short time delay such as one minute, and coil KT2 maintains these contacts closed thereafter so long as the coil is energized. The energization of coil K3 closes contacts CR3 in lines 1 and 3. Closed contacts CR3 in line 1 are in parallel with start switch St.S. and thus provide a holding current for relay coils K3 and KT2, allowing release of the start switch. When contacts CR3 in line 3 close, current is conducted through switch PT-4, through closed contacts CR1 in line 4, through closed contacts CR3 in line 3, through switch PT-1, and through normally closed contacts CRT3 in line 5, energizing Program Timer PT.

After Program Timer PT is energized, switch PT-1 moves to the position shown in broken lines in FIG. 2. This provides a holding current for Program Timer PT via line 5 and normally closed contacts CR4 and CRT3 therein. Next, switch PT-2 moves to the position shown in broken lines in FIG. 2, energizing oil pump relay coil o.p. which then starts an oil pump (not shown) for compressor motor 50. After a short time delay to allow oil pressure in compressor motor 50 to increase to an acceptable level, Program Timer PT opens switch PT-4, and then the Program Timer closes switch PT-3 to start compressor motor 50. With switch PT-4 open, the process of starting compressor motor 50 will continue only if safety switch Saf.S. in line 2 of FIG. 2 is closed. Safety switch Saf.S. schematically represents a plurality of safety switches which prevent or terminate operation of compressor motor 50 upon development of undesirable conditions such as low oil pressure in the compressor motor. Additional safety devices are well known in the art and may be easily used with machine 10 by those skilled in the art.

If all of the parameters sensed by safety switch Saf.S. are within acceptable ranges, the safety switch is closed. Current passes through safety switch Saf.S., through closed contacts CR1 in line 4, through closed contacts CR3 in line 3, and through switch PT-3, energizing relay coil K4 in line 3. When relay coil K4 is energized, relay contacts CR4 in lines 3 and 16 close and contacts CR4 in line 5 open. Contacts CR4 in line 3 are in parallel with switch PT-3 and provide a holding current for relay coil K4, allowing switch PT-3 to open. Contacts CR4 in line 5 are in series with Program Timer PT; and when these contacts open, the program timer is deenergized. Contacts CR4 in line 16 are in series with compressor motor 50; and when these contacts close, the compressor motor is activated. In practice, a motor starter (not shown) may be activated in response to the energization of coil K4 and employed to facilitate starting compressor motor 50. Thus compressor motor 50 is started, refrigeration machine 10 is put into operation, and Program Timer PT is de-energized. As will be appreciated, if safety switch Saf.S. is open when switch PT-3 closes, then coil K4 is not energized and motor 50 is not started until the safety switch closes. Similarly, if safety switch Saf.S. opens while motor 50 is operating, coil K4 is de-energized, contacts CR4 in line 16 open, and motor 50 is deactivated until the safety switch recloses.

Referring back to FIG. 1, in operation, first stage 16 of compressor 18 discharges hot, compressed refrigerant vapor into primary condenser 20 via line 52. Refrigerant passes through primary condenser 20, rejects heat to an external heat exchange medium such as water circulating through heat exchange coil 54 located therein and condenses. The condensed refrigerant flows through primary expansion means 22, reducing the temperature and pressure of the refrigerant. The expanded refrigerant enters and passes through evaporator 24 and absorbs heat from an external heat transfer medium such as water passing through heat exchange coil 56 which is positioned within the evaporator. The heat transfer medium is thus cooled and the refrigerant is evaporated. The cooled heat transfer medium may then be used to satisfy a cooling load, and the evaporated refrigerant is drawn from evaporator 24 into line 58 leading back to first stage 16 of compressor 18.

As described above, first stage 16 and primary expansion means 22 separate cooling circuit 12 into high pressure side 60 and low pressure side 62, and booster inlet line 64 is provided for transmitting refrigerant vapor from the high pressure side of the cooling circuit to second stage 26 of compressor 18. In the embodiment depicted in FIG. 1, inlet line 64 is connected to condenser 20 and transmits a portion of the refrigerant vapor passing through the condenser to second stage 26 of compressor 18. Alternately, line 64 could be directly connected to discharge line 52. Second stage 26 of compressor 18 further compresses the vapor transmitted thereto, further raising the temperature and pressure of the vapor. This further compressed vapor is discharged into line 66, leading to heat reclaiming condenser 30.

The refrigerant vapor enters and passes through heat reclaiming condenser 30 in heat transfer relation with a heat transfer fluid such as water passing through heat exchange coil 70 disposed within the heat reclaiming condenser. Heat is transferred from the refrigerant vapor to the fluid passing through coil 70, heating the fluid and condensing the refrigerant. The heated heat transfer fluid may then be employed to satisfy a heating load. Refrigerant condensed in heat reclaiming condenser 30 passes therefrom back to cooling circuit 12 via return means including auxiliary expansion means 32 and refrigerant lines 72 and 74. More particularly, condensed refrigerant from heat reclaiming condenser 30 flows through orifice 32 via line 72, reducing the pressure and temperature of the refrigerant. Refrigerant line 74 transmits refrigerant from orifice 32 back to cooling circuit 12, specifically primary expansion device 22 thereof, for further use in the cooling circuit.

Guide vanes 34 may be controlled in response to any one or more of a number of factors indicative of changes in the load on cooling circuit 12 to vary the capacity thereof. For example, guide vanes 34 may be controlled in response to the temperature of the fluid leaving heat exchanger 56 of evaporator 24. As the cooling load increases or decreases, guide vanes 34 move between their minimum and maximum flow positions to increase or decrease, respectively, the refrigerant flow rate through cooling circuit 12. Similarly, valve 38 may be governed in response to any one or more of a number of factors indicating changes in the load on heating circuit 14 to vary the capacity thereof. For example, valve 38 may be controlled in response to the temperature of the fluid discharged from heat exchanger 70 of heat reclaiming condenser 30. Referring to FIG. 2, when the heating load is increasing, normally open switch 76 in line 13 is closed, activating motor 40 to move valve 38 toward its maximum flow position to increase the flow rate through heating circuit 14. In contrast, when the heating load is decreasing, normally open switch 78 in line 15 is closed, activating motor 40 to move valve 38 toward its minimum flow position to reduce the flow rate through heating circuit 14. It should be noted that switches 76 and 78 may be mechanical devices, or these switches may be solid state electronic elements.

Thus, with the above-discussed control of valve 38, as the heating load on machine 10 decreases, the refrigerant flow rate through heating circuit 14 also decreases. Moreover, as the flow rate through booster compressor 26 decreases, the temperature of the vapor discharged therefrom tends to increase. As discussed above, if the refrigerant flow rate through booster compressor 26 is very low, the temperature of the vapor discharged therefrom may approach a level where the refrigerant may chemically break down into components that may damage the structure of machine 10. In light of this, machine 10 is uniquely designed to terminate the heating action of heating circuit 14, thus reducing temperatures therein, when the temperature of the vapor discharged from booster compressor 26 exceeds a preset value.

In the preferred embodiment illustrated in FIGS. 1 and 2, the above-mentioned heat terminating means includes thermostatic switch Th.S. and vent line 42. Thermostatic switch Th.S. is positioned in heat transfer relation with refrigerant vapor discharged from second stage 26 of compressor 18, for example the thermostatic switch may be secured to line 66. Thermostatic switch Th.S. is electrically located in line 9 of FIG. 2, in series with relay coil K1 and, as previously mentioned, the thermostatic switch is normally closed. When the temperature of the vapor discharged from booster compressor means 26 exceeds the preset value, thermostatic switch Th.S. opens. When this occurs, referring to FIG. 2, relay coil K1 is de-energized, opening contacts CR1 in line 4 and closing contacts CR1 in line 10 which are associated with Timer Relay KT1 in line 11. Timer Relay KT1 is a delay off, solid state timer that is electronically locked into an energized state when contacts CR1 in line 10 close, and the timer relay remains energized so long as contacts CR1 in line 10 remain closed and for a predetermined length of time after these contacts open. When timer relay KT1 in line 11 is activated, contacts CRT1 in line 12 open, deactivating relay coil K2. This, in turn, opens contacts CR2 in line 13 and closes contacts CR2 in lines 8 and 14. With contacts CR2 in line 13 open, motor 40 cannot be activated by the closing of switch 76 to open valve 38. In fact, with contacts CR2 in line 14 closed, switch 78 is bypassed and motor 40 is energized to move valve 38 towards its minimum flow position, decreasing the refrigerant flow rate through heating circuit 14. At the same time, when contacts CR2 in line 8 close, vent solenoid 46 is activated.

Referring back to FIG. 1, activation of solenoid 46 opens vent line valve 44, allowing fluid flow through vent line 42. Heating circuit 14 is thus brought into communication with low pressure side 62 of cooling circuit 12. Specifically, a first end of vent line 42 is connected to line 72 and a second end of the vent line is connected to evaporator 24. Alternately, as will be apparent to those skilled in the art, the first end of vent line 42 could be connected to heat reclaiming condenser 30 or to discharge line 66, and the second end of the vent line could be connected to inlet line 58. Since the pressure in evaporator 24 is less than the pressure in heat reclaiming condenser 30 and discharge line 66 leading thereto, bringing heating circuit 14 into communication with the evaporator as described above lowers the refrigerant pressure in condenser 30 and line 66. This reduces the size of the pressure increase which booster compressor 26 must produce in the refrigerant passing therethrough, reducing the temperature increase which occurs as the refrigerant is compressed by the booster compressor. In this manner, the temperature of vapor discharged from booster compressor 26 is reduced, preventing the vapor from reaching temperatures that may cause the refrigerant to break down into potentially damaging components.

When the temperature of the vapor discharged from booster compressor 26 falls below the preset value, thermostatic switch Th.S. closes, re-energizing coil K1 and, thus, opening contacts CR1 in line 10 of FIG. 2. Timer relay KT1 in line 11, however, remains energized until it runs for a preset length of time. This time delay enables the heating load which will be placed on circuit 14 when the circuit is reactivated to increase, insuring at least moderate vapor flow through the heating circuit when heating is reactivated. When timer KT1 automatically deactivates, contacts CRT1 in line 12 close, and coil K2 is energized. Vent line valve 44 is thus closed via action of solenoid 46 and contacts CR2 in line 8, and control of motor 40 is returned to switches 76 and 78 due to the closing of contacts CR2 in line 13 and the opening of contacts CR2 in line 14.

As mentioned above, the most desired, complete response of machine 10 to the vapor temperature in heating circuit 14 approaching excessive levels depends upon operating conditions of cooling circuit 12. More particularly, if the load on cooling circuit 12 is relatively high when action of heating circuit 14 is terminated because vapor temperatures therein are approaching excessive values, then preferably operation of the cooling circuit is continued unaffected by the action of the heating circuit. In contrast, if the load on cooling circuit 12 is relatively low as action of heating circuit 14 is terminated, then preferably operation of cooling circuit 12 is simultaneously terminated. It is desirable to terminate action of cooling circuit 12 under these latter conditions because otherwise all of the heat rejected by the refrigerant passing through the cooling circuit would be rejected via primary condenser 20, and it is preferred to temporarily terminate action of the cooling circuit until a later time when this heat can be recovered via heat reclaiming condenser 30.

In view of the above, sensing means is provided for sensing the cooling load or demand on machine 10. In the preferred embodiment illustrated in the drawings, the sensing means includes guide vane switch G.V.S. for sensing the position of guide vanes 34. Guide vane switch G.V.S. is open when the load on cooling circuit 12 is below a predetermined value, closes when guide vanes 34 reach a position indicating that the load on circuit 12 equals the predetermined value, and remains closed as long as the load on the cooling circuit is at or above the predetermined value. Referring to FIG. 2, guide vane switch G.V.S. is electrically located in line 3 thereof. If guide vane switch G.V.S. is closed when thermostatic switch Th.S. opens, cooling circuit 12 continues to operate because, despite the opening of contacts CR1 in line 4, current is still conducted through relay coil K4 via guide vane switch G.V.S. in line 3. Since coil K4 remains energized, contacts CR4 in line 16 remain closed and compressor motor 50 remains connected to the source of electrical energy. Thus, machine 10 changes from a "heating and cooling" mode of operation to a "cooling only" mode of operation.

However, if guide vane switch G.V.S. is open when thermostatic switch Th.S. opens, the operation of machine 10, including the action of cooling circuit 12, is temporarily terminated. More particularly, as contacts CR1 in line 4 open in response to the opening of thermostatic switch Th.S. in line 9, if, at the same time, guide vane switch G.V.S. is open, then relay coil K4 in line 3 is disconnected from the electrical energy source and, hence, de-energized. When this happens, contacts CR4 in line 5 close and contacts CR4 in lines 3 and 16 open. The opening of contacts CR4 in line 16 disconnects compressor motor 50 from the source of electrical energy. Compressor 18 is deactivated and operation of machine 10 is terminated. Simultaneously, the closing of contacts CR4 in line 5 energizes Program Timer PT. Program Timer PT continues with its control sequence, and opens switch PT-3 to reset this switch for later restarting the compressor motor. Then switch PT-4 closes to maintain relay coils K3 and KT2 energized despite the possible opening of safety switch Saf.S. Next, switch PT-2 moves to the position shown in full line in FIG. 2, deactivating oil pump o.p. and energizing relay timer KT3 via line 7 and closed contacts CRT2 therein. When timer KT3 is energized, contacts CRT3 in line 5 open, deactivating Program Timer PT.

Timer KT3 maintains compressor motor 50 and refrigeration machine 10 inactive for a predetermined length of time to prevent motor 50 and machine 10 from cycling on and off at an undesirably high frequency. Delaying the restart of machine 10 also increases the heating and cooling loads placed thereon when the machine is restarted. In this manner, machine 10 and specifically motor 50 will operate at a higher, more efficient capacity when restarted. When timer KT3 deactivates, contacts CRT3 in line 5 close, energizing Program Timer PT, and the program timer continues with its control sequence. Specifically, Program Timer PT moves switch PT-1 to the position shown in full line in FIG. 2. This is the last step in the control sequence of Program Timer PT, and when it is completed, the Program Timer starts to repeat its control sequence. Particularly, switches PT-1 and PT-2 are moved back to the positions shown in broken lines in FIG. 2. It should be noted that timer relay KT3 in line 7 is an "interval timer" and, once it deactivates, must be disconnected from the source of electrical energy before it can be reactivated. Thus, timer KT3 does not immediately restart after automatically deactivating despite the fact that at the time the timer deactivates, switch PT-2 is in the position shown in full line and the timer is connected to the electrical energy source. Next, switch PT-4 moves to the open position to insure that compressor motor 50 is not restarted unless safety switch Saf.S. is closed, and then switch PT-3 is closed. Preferably, the dwell time for timer KT3 is greater than the dwell time for timer KT1 in line 11. Hence, when switch PT-3 is closed as a consequence of timer KT3 deactivating, contacts CR1 in line 4 are closed, and the closing of switch PT-3 starts compressor motor 50 as explained above.

As will be apparent to those skilled in the art, valves 38 and 44 may be positioned by means other than electric motor 40 and electric solenoid 46 respectively. For example, hydraulic or pneumatic devices may be employed to position valves 38 and 44. Further, the temperature of vapor discharged from booster compressor 26 may be sensed by means other than a thermostatic switch, for example a thermosensitive bulb may be used. Additionally, it should be noted that the heating action of circuit 14 may be terminated in a number of ways other than as specifically described herein. For example, in a machine employing separate drive means to drive primary and booster compressors 16 and 26, the heating action of circuit 14 may be terminated by deactivating the booster compressor drive means.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. Apparatus for satisfying heating and cooling demands comprising:

a cooling circuit for satisfying the cooling demand and including a high pressure side and a low pressure side;

a heating circuit for satisfying the heating demand and including a booster compressor for drawing and compressing refrigerant vapor from the high pressure side of the cooling circuit, and return means for returning refrigerant from the heating circuit to the cooling circuit;

a sensor for sensing the temperature of vapor discharged from the booster compressor; and means responsive to the sensor for terminating the heating action of the heating circuit when the temperature of the vapor discharged from the booster compressor exceeds a preset temperature, the terminating means including means for reducing the vapor flow rate through the heating circuit, and means for venting vapor in the heating circuit to a low pressure region to lower the pressure of vapor in the heating circuit.

2. The apparatus as defined by claim 1 wherein the reducing means includes:

a valve for regulating the flow of vapor through the booster compressor; and positioning means connected to the valve and the sensor for positioning the valve to decrease the vapor flow rate through the booster compressor when the temperature of the vapor discharged therefrom exceeds the preset temperature.

3. The apparatus as defined by claim 2 wherein:

the valve includes a modulating valve;

the positioning means includes a reversible electric motor for modulating the valve between minimum and maximum flow positions; and the temperature sensor includes a thermostatic switch for connecting the electric motor to a source of electrical energy to move the valve toward the minimum flow position when the temperature of the vapor discharged from the booster compressor exceeds the preset temperature.

4. Apparatus for satisfying heating and cooling demands comprising:

a cooling circuit for satisfying the cooling demand and including a high pressure side and a low pressure side;

a heating circuit for satisfying the heating demand and including a booster compressor for drawing and compressing refrigerant vapor from the high pressure side of the cooling circuit, and return means for returning refrigerant from the heating circuit to the cooling circuit;

a sensor for sensing the temperature of vapor discharged from the booster compressor;

means responsive to the sensor for terminating the heating action of the heating circuit when the temperature of the vapor discharged from the booster compressor exceeds a preset temperature;

means for sensing the demand on the cooling circuit; and means for terminating the cooling action of the cooling circuit when both the cooling demand is below a predetermined load and the temperature of the vapor discharged from the booster compressor exceeds the preset temperature.

5. The apparatus as defined by claim 4 wherein:

the heating action terminating means includes means for venting vapor in the heating circuit to a low pressure region to lower the pressure of vapor in the heating circuit; and the cooling action terminating means includes means for deactivating a drive means for a compressor of the cooling circuit.

6. The apparatus as defined by claim 5 wherein:

the compressor drive means includes an electric motor;

the temperature sensor includes a thermostatic switch;

the cooling demand sensor includes a limit switch for sensing the position of a guide vane of the compressor of the cooling circuit; and the deactivating means includes electrical contact means electrically connected to the thermostatic switch, the limit switch, and the electric motor for disconnecting the motor from an electrical energy source when both the temperature of the vapor discharged from the booster compressor exceeds the preset temperature and the demand on the cooling circuit is below the predetermined load.

7. The apparatus as defined by claims 1, 2, 3, 5, or 6 wherein the venting means includes:

a vent line for transmitting refrigerant from the heating circuit to the low pressure side of the cooling circuit;

a vent line valve for regulating the flow of refrigerant through the vent line; and means for opening the vent line valve when the temperature of the vapor discharged from the booster compressor exceeds the preset temperature.

8. The apparatus as defined by claim 7 wherein the opening means includes a solenoid.

9. A control for a booster type heat reclaiming refrigeration machine having a cooling circuit for satisfying a cooling demand, a heating circuit for satisfying a heating demand, a vent line for venting refrigerant from the heating circuit to a low pressure area, a vent line valve for regulating the flow of refrigerant through the vent line, and means for opening the vent line valve, the cooling circuit having a primary compressor for drawing vapor from a low pressure side of the cooling circuit, compressing the vapor, and discharging the vapor into a high pressure side of the cooling circuit, and the heating circuit having a booster compressor for drawing and further compressing vapor from the high pressure side of the cooling circuit, a booster valve for regulating the flow of refrigerant through the booster compressor, and positioning means for positioning the booster valve, the control comprising:

a sensor for sensing the temperature of the vapor discharged from the booster compressor; and means for connecting the positioning means and the opening means to the sensor for operating the positioning means and the opening means to move the booster valve to decrease the vapor flow rate through the booster compressor and to open the vent line valve and allow refrigerant flow through the vent line when the temperature of the vapor discharged from the booster compressor rises above a preset temperature.

10. The control as defined by claim 9 for use with a refrigeration machine having an electric motor for positioning the booster valve and a solenoid for opening the vent line valve, wherein:

the sensor includes a thermostatic switch in heat transfer relation with vapor discharged from the booster compressor; and the connecting means includes electrical contact means associated with the thermostatic switch for connecting the electric motor and the solenoid to an electrical energy source when the temperature of the vapor discharged from the booster compressor exceeds the preset temperature to move the booster valve to decrease the vapor flow rate through the booster compressor and to open the vent line valve.

11. A control for a booster type heat reclaiming refrigeration machine having a cooling circuit for satisfying a cooling demand and a heating circuit for satisfying a heating demand, the cooling circuit having a primary compressor for drawing vapor from a low pressure side of the cooling circuit, compressing the vapor, and discharging the vapor into a high pressure side of the cooling circuit; the heating circuit having a booster compressor for drawing and further compressing vapor from the high pressure side of the cooling circuit, a booster valve for regulating the flow of refrigerant through the booster compressor, and positioning means for positioning the booster valve; the refrigeration machine further having drive means for driving the primary compressor, a vent line for venting refrigerant from the heating circuit to a low pressure area, a vent line valve for regulating the flow of refrigerant through the vent line, and means for opening the vent line valve, the control comprising:

a temperature sensor for sensing the temperature of vapor discharged from the booster compressor;

a cooling load sensor for sensing the demand on the cooling circuit;

valve regulating means for connecting the positioning means and the opening means to the temperature sensor to activate the positioning means and the opening means to, respectively, move the booster valve to decrease the vapor flow through the booster compressor and open the vent line valve when the temperature of vapor discharged from the booster compressor exceeds a preset temperature; and drive regulating means for connecting the temperature sensor and the cooling load sensor to the primary compressor drive means to deactivate the drive means when both the temperature of the vapor discharged from the booster compressor exceeds the preset temperature and the cooling demand is below a predetermined load.

12. The control as defined by claim 11 for use with a refrigeration machine having a first electric motor for positioning the booster valve, a second electric motor for driving the primary and booster compressors; means for connecting the second electric motor to a source of electrical energy, and a solenoid for opening the vent line valve, wherein:

the temperature sensor includes a thermostatic switch;

the cooling load sensor includes a limit switch for sensing the position of an inlet guide vane of the primary compressor;

the valve regulating means includes first electrical contact means associated with the thermostatic switch for connecting the solenoid and the first electric motor to the source of electrical energy when the temperature of the vapor discharged from the booster compressor exceeds the preset temperature;

the drive regulating means includes second electrical contact means associated with the thermostatic switch and the limit switch for disconnecting the second electric motor from the electrical energy source when both the temperature of vapor discharged from the booster compressor exceeds the preset temperature and the demand on the cooling circuit is below the predetermined load.

13. The control as defined by claim 12 further including:

first electric timer means for maintaining the first electric motor and the solenoid connected to the electrical energy source for a first preset length of time; and second electric timer means for maintaining the second electric motor disconnected from the electrical energy source for a second preset length of time.

14. A method of controlling the operation of a booster type heat reclaiming refrigeration machine including a cooling circuit having a low pressure side and a high pressure side for satisfying a cooling load, and a heating circuit for satisfying a heating load, the method comprising the steps of:

passing refrigerant vapor from the high pressure side of the cooling circuit through the heating circuit;

compressing refrigerant vapor passing through the heating circuit;

transferring heat from the refrigerant passing through the heating circuit to a first heat transfer fluid for satisfying the heating load and to condense the refrigerant; and terminating the transferring step when the temperature of the refrigerant passing through the heating circuit exceeds a preset temperature, wherein the terminating step includes the steps of reducing the vapor flow rate through the heating circuit, and venting vapor from the heating circuit to a low pressure region to lower the pressure in the heating circuit.

15. The method as defined by claim 14 further including the steps of:

increasing the vapor flow rate through the heating circuit when the temperature of the refrigerant passing therethrough falls below the preset temperature; and delaying the increasing step for a predetermined length of time.

16. A method of controlling the operation of a booster type heat reclaiming refrigeration machine including a cooling circuit having a low pressure side and a high pressure side for satisfying a cooling load, and a heating circuit for satisfying a heating load, the method comprising the steps of:

passing refrigerant vapor from the high pressure side of the cooling circuit through the heating circuit;

compressing refrigerant vapor passing through the heating circuit;

transferring heat from the refrigerant passing through the heating circuit to a first heat transfer fluid for satisfying the heating load and to condense the refrigerant;

terminating and transferring step when the temperature of the refrigerant passing through the heating circuit exceeds a preset temperature;

compressing refrigerant vapor passing through the cooling circuit; and terminating the steps of compressing refrigerant vapor passing through the heating and cooling circuits when both the temperature of the refrigerant passing through the heating circuit exceeds the preset temperature and the load on the cooling circuit is below a predetermined load.

17. The method as defined by claim 16 further including the step of:

restarting the steps of compressing refrigerant vapor passing through the heating and cooling circuits a predetermined length of time after the compressing steps are terminated.

18. Apparatus for satisfying heating and cooling demands comprising:

a cooling circuit for satisfying the cooling demand and including a high pressure side and a low pressure side;

a heating circuit for satisfying the heating demand and including a booster compressor for drawing and compressing refrigerant vapor from the high pressure side of the cooling circuit, and return means for returning refrigerant from the heating circuit to the cooling circuit;

a sensor for sensing the temperature of vapor discharged from the booster compressor; and means responsive to the sensor for reducing the vapor flow rate through the heating circuit and venting vapor therein to a low pressure region to lower the pressure of vapor in the heating circuit when the temperature of vapor discharged from the booster compressor exceeds a preset temperature.

19. Apparatus as defined by claim 18 wherein the means responsive to the sensor includes:

a booster compressor valve for regulating the flow of vapor through the booster compressor;

positioning means connected to the booster compressor valve and the sensor for positioning the valve to decrease the vapor flow rate through the booster compressor when the temperature of the vapor discharged therefrom exceeds the preset temperature;

a vent line for transmitting refrigerant from the heating circuit to the low pressure side of the cooling circuit;

a vent line valve for regulating the flow of refrigerant through the vent line; and means for opening the vent line valve when the temperature of the vapor discharged from the booster compressor exceeds the preset temperature.

20. A method of controlling the operation of a booster type heat reclaiming refrigeration machine including a cooling circuit having a low pressure side and a high pressure side for satisfying a cooling load, and a heating circuit for satisfying a heating load, the method comprising the steps of:

passing refrigerant vapor from the high pressure side of the cooling circuit through the heating circuit;

compressing refrigerant vapor passing through the heating circuit;

transferring heat from the refrigerant passing through the heating circuit to a first heat transfer fluid for satisfying the heating load and to condense the refrigerant; and reducing the vapor flow rate through the heating circuit and venting vapor therefrom to a low pressure region to lower the vapor pressure in the heating circuit when the temperature of the refrigerant passing through the heating circuit exceeds a preset temperature.

* * * * *

UNITED STATES PATENT AND TRADEMARK OFFICE

CERTIFICATE OF CORRECTION

PATENT NO. : 4,309,876

DATED : January 12, 1982

INVENTOR(S) : GARY S. LEONARD/THOMAS M. ZINSMEYER

It is certified that error appears in the above-identified patent and that said Letters Patent are hereby corrected as shown below:

Column 1, line 42, "has" should read -- as --.

Signed and Sealed this

*Eighteenth* Day of *May 1982*

[SEAL]

*Attest:*

GERALD J. MOSSINGHOFF

*Attesting Officer*

*Commissioner of Patents and Trademarks*